US006514385B2

(12) United States Patent
Scherb et al.

(10) Patent No.: US 6,514,385 B2
(45) Date of Patent: Feb. 4, 2003

(54) PRESS SECTION WITH ALTERNATIVES PRESS SHOES OF DIFFERENT LENGTH

(75) Inventors: Thomas Thoröe Scherb, Sao Paulo; Harald Schmidt-Hebbel, Barueri, both of (BR)

(73) Assignee: Voith Paper Patent GmbH, Heidenheim (DE)

( * ) Notice: Subject to any disclaimer, the term of this patent is extended or adjusted under 35 U.S.C. 154(b) by 0 days.

(21) Appl. No.: 09/742,002

(22) Filed: Dec. 22, 2000

(65) Prior Publication Data

US 2002/0096302 A1 Jul. 25, 2002

(30) Foreign Application Priority Data

Dec. 23, 1999 (DE) ..... 199 62 706

(51) Int. Cl.[7] ..... D21F 3/02

(52) U.S. Cl. ..... 162/205; 162/272; 162/358.3; 100/153

(58) Field of Search ..... 162/272, 205, 162/358.3, 361; 100/118, 153

(56) References Cited

U.S. PATENT DOCUMENTS

| | | | | |
|---|---|---|---|---|
| 4,503,765 A | | 3/1985 | Schiel | |
| 4,555,305 A | * | 11/1985 | Steiner et al. | 162/358.3 |
| 4,705,602 A | * | 11/1987 | Dahl | 162/358.3 |
| 5,522,959 A | | 6/1996 | Ilmarinen | |
| 5,639,351 A | | 6/1997 | Ilmarinen | |
| 5,705,034 A | * | 1/1998 | Schiel | 162/358.3 |
| 6,004,429 A | | 12/1999 | Schiel | |
| 6,197,156 B1 | | 3/2001 | Ilmarinen | |
| 6,210,530 B1 | * | 4/2001 | Loser et al. | 162/358.3 |
| 6,235,160 B1 | | 5/2001 | Tietz et al. | |

FOREIGN PATENT DOCUMENTS

| | | |
|---|---|---|
| DE | 3205664 | 8/1983 |
| EP | 0549553 | 6/1993 |
| EP | 0854229 | 7/1998 |
| EP | 0926296 | 6/1999 |

OTHER PUBLICATIONS

Leffler, "Through–Air Drying technology for absorbent, soft and high–bulk tissue", *Paper Technology* (Sep. 1998).

* cited by examiner

*Primary Examiner*—Karen M. Hastings
(74) *Attorney, Agent, or Firm*—Greenblum & Bernstein, P.L.C.

(57) ABSTRACT

Press section of a machine and process for producing webs. The press section includes a shoe press including a shoe press unit and a counter roll. The shoe press unit includes at least two press shoes and an elastic liquid-impermeable press belt guided over the at least two press shoes, and the at least two press shoes have different lengths measured in a web travel direction and each of the two press shoes is arranged for movement (i.e. alternatively positionable) between an idle position and a press position facing the counter roll.

41 Claims, 4 Drawing Sheets

PRESS SECTION WITH ALTERNATIVES PRESS SHOES OF DIFFERENT LENGTH

CROSS-REFERENCE TO RELATED APPLICATIONS

The present application claims priority under 35 U.S.C. §119 of German Patent Application No. 199 62 706.1, filed on Dec. 23, 1999, the disclosure of which is expressly incorporated by reference herein in its entirety.

BACKGROUND OF THE INVENTION

1. Field of the Invention

The invention relates to a press section of a machine for producing tissue webs, having a shoe press containing a shoe press unit and a counter roll, whose shoe press unit has at least two press shoes and an elastic liquid-impermeable pressing belt guided over these press shoes.

2. Discussion of Background Information

From DE 32 05 664 A1, a shoe roll with at least two press shoes is known for use in a press section of a paper machine, for example. The press shoes are pivotable around an axis parallel to the pressing plan and can differ in their bending radius. This allows optimal press performance to be achieved for the entire thickness spectrum of the sorts of paper produced on a paper machine, i.e., as high a dry content as possible can be achieved.

However, since tissue webs are very thin, the transmission of this knowledge does not result in an improvement of the product quality in the tissue production. Between the different types, only irrelevant thickness differences occur. The application is therefore uneconomical due to the larger investment expense of the described shoe press.

SUMMARY OF THE INVENTION

The present invention provides a press section of the above-mentioned type that allows an economical production of tissue and simultaneously ensures a better product quality.

According to the invention, the two press shoes have different lengths measured in the web travel direction and can each be transferred from an idle position to a press position in which the press shoe in question is positioned opposite the counter roll.

With the press shoe being transferable between an idle position and a press position, press nips of different lengths can be realized quickly and without any reconfiguration expense.

Depending on use, different quality standards are required from tissue products. There are products for which the specific volume ("bulk") is a deciding quality feature. In other products, it can be more important for economical reasons to accept a lower specific volume in exchange for a high dry content, i.e., a high production. Because of the embodiment according to the invention, it is now possible to change between these types in the tissue production without having to compromise concerning the adjustment of the machine setting and the press setting, as previously necessary. Now the optimal situation can be achieved in each case.

A shoe press roll with a press jacket forming the press belt is provided as the shoe press unit.

For achieving a high specific volume, it is advantageous if at least one press shoe is provided whose length measured in the web travel direction is greater than about 80 mm, greater than or equal to about 100 mm, preferably greater than or equal to about 120 mm. Here, the highest pressure of the pressure progression occurring in a press nip between the press shoe and the counter roll in the web travel direction is preferably selected to be less than or equal to a value of about 2.5 MPa, in particular less than or equal to about 2 MPa, preferably less than or equal to about 1.5 MPa.

On the other hand, it is advantageous for achieving as high a dry content as possible after the press when at least one press shoe is provided whose length measured in the web travel direction is less than or equal about 60 mm and, in particular, less than or equal to about 50 mm and preferably has a value in the range of about 37 mm. Here, the maximal pressure of a pressure progression occurring in a press nip between the press shoe and the counter roll in the web travel direction in a shoe length less than or equal to about 60 mm is preferably selected to be greater than or equal to a value of about 3.3 MPa, at a shoe length less than or equal to about 50 mm preferably greater than or equal to a value of about 4.3 MPa and, at a shoe length in the range of about 37 mm, preferably equal to a value in the range of about 4.8 MPa.

It is particularly advantageous if a heated drying cylinder is provided as a counter roll, particularly a so-called Yankee cylinder that has a considerably larger diameter than the shoe press roll if the shoe press unit is formed by a shoe press roll.

When using the Yankee cylinders, the maximal linear force is frequently limited to a value of about 90 kN/m to 120 kN/m due to excessively large deformations and tensions that occur in a Yankee cylinder. This again limits the maximal pressure for a press shoe designed for high bulk and thus the maximum achievable dry content for the tissue web. This results in a reduction of the machine speed and a higher drying expense at the drying cylinder. By using a shoe press with at least two different press shoes according to the invention, this disadvantage is omitted.

A further increase in dry content can be achieved in that, in a press nip surfaced with felt formed between a shoe press unit and a counter roll, preferably a drying roll, the angle between the tangent coming in contact with the counter roll at the end of the press nip and at least one of the felts leaving the press nip is advantageously greater than or equal to about 10°, in particular greater than or equal to about 15°, in particular greater than or equal to about 18°, and preferably greater than or equal to about 20°. In such a case, particularly, the press belt can be provided with a grooved (ribbed) surface in the circumferential direction that additionally aids in the increase of the dry content. A ribbed press belt is therefore preferably used when a in tissue machine tissues are produced that mainly require a high cry content.

Otherwise, a blind-bored and/or grooved press belt can be used in particular.

The present invention is directed to a press section of a machine for producing webs. The press section includes a shoe press including a shoe press unit and a counter roll. The shoe press unit includes at least two press shoes and an elastic liquid-impermeable press belt guided over the at least two press shoes, and the at least two press shoes have different lengths measured in a web travel direction and each of the two press shoes is arranged for movement between an idle position and a press position facing the counter roll.

In accordance with a feature of the instant invention, the web can include a tissue web.

According to another feature of the invention, the shoe press unit may include a shoe press roll having a press jacket arranged to form the press belt, and the shoe press roll can include the at least two press shoes.

At least one of the at least two press shoes may have a length in the web travel direction greater than about 80 mm. A maximal pressure of a pressure progression occurring within a press nip formed between the at least one press shoe and the counter roll can be less than or equal to a value of about 2.5 MPa.

At least one of the at least two press shoes may have a length in the web travel direction less than or equal to about 60 mm. A maximal pressure of a pressure progression occurring within a press nip formed between the at least one press shoe and the counter roll can be greater than or equal to a value of about 3.3 MPa.

At least one of the at least two press shoes may have a length in the web travel direction less than or equal to about 50 mm. A maximal pressure of a pressure progression occurring within a press nip formed between the at least one press shoe and the counter roll can be greater than or equal to a value of about 4.3 MPa.

At least one of the at least two press shoes has a length in the web travel direction less than or equal to about 37 mm. A maximal pressure of a pressure progression occurring within a press nip formed between the at least one press shoe and the counter roll can be greater than or equal to a value of about 4.8 MPa.

In accordance with a further feature of the present invention, the counter roll may include a heatable drying cylinder. Further, the heatable drying cylinder can include a Yankee cylinder.

Further, a press felt can be guided through a press nip formed between the shoe press unit and the counter roll. The press felt may be guided from an end of the press nip at an angle of greater than or equal to about 10° to a tangent to the counter roll at the press nip exit. Moreover, the press felt can be guided from the end of the press nip at an angle of greater than or equal to about 15° to the tangent, the press felt can be guided from the end of the press nip at an angle of greater than or equal to about 18° to the tangent, and preferably, the press felt may be guided from the end of the press nip at an angle of greater than or equal to about 20° to the tangent. The press belt can have a grooved surface in a circumferential direction.

In accordance with still another feature of the invention, the press belt can be one of blind bored and grooved.

According to another feature of the invention, a thin fabric may be arranged between the at least one press felt and the web. The thin fabric can be one of a dewatering wire and an imprinting wire. Further, the thin fabric may have a thickness less than about 2 mm, and advantageously less than about 1 mm.

According to a still further feature of the instant invention, the at least two press shoes may be arranged for alternative positioning in the press position.

Moreover, the shoe press unit can include a rotatable carrier, and the at least two press shoes are coupled to the rotatable carrier. The rotatable carrier may be arranged to alternatively move the at least two press shoes between the idle position and the press position.

The instant invention is directed to an apparatus for producing webs. The apparatus includes a shoe press unit including at least two press shoes having different lengths in a web run direction and a flexible, liquid impermeable press belt guided over the at least two press shoes, and a counter roll. The at least two press shoes may be alternatively positionable to form a press nip against the counter roll.

In accordance with a feature of the present invention, a first of the at least two press shoes can have a length in the web travel direction greater than about 80 mm and a second of the at least two press shoes can have a length in web travel direction of less than or equal to about 60 mm. A maximal pressure of a pressure progression occurring within the press nip formed between the first press shoe and the counter roll may be less than or equal to a value of about 2.5 MPa, and a maximal pressure of a pressure progression occurring within the press nip formed between the second press shoe and the counter roll may be greater than or equal to a value of about 3.3 MPa.

Moreover, the second press shoe may have a length in the web travel direction less than or equal to about 50 mm, and the maximal pressure of a pressure progression occurring within the press nip formed between the second press shoe and the counter roll can be greater than or equal to a value of about 4.3 MPa.

Further, the second press shoe can have a length in the web travel direction less than or equal to about 37 mm, and the maximal pressure of a pressure progression occurring within the press nip formed between the second press shoe and the counter roll may be greater than or equal to a value of about 4.8 MPa.

According to still another feature of the invention, the shoe press unit may include a rotatable carrier, and the at least two press shoes can be coupled to the rotatable carrier.

In accordance with a further feature of the present invention, the rotatable carrier may be arranged to alternatively move the at least two press shoes between the idle position and the press position.

The present invention is directed to a process for producing a web in an apparatus that includes a shoe press unit and an counter roll, the shoe press unit includes at least two press shoes having different lengths and an elastic liquid-impermeable press belt guided over the at least two press shoes. The process includes alternatively positioning one of the at least two press shoes into a press position to face the counter roll, whereby the other of the at least two press shoes is positioned in an idle position, and guiding the web through a press nip formed between the one press shoe in the press position and the counter roll.

In accordance with a feature of the instant invention, a first of the at least two press shoes may have a length in the web travel direction greater than about 80 mm and a second of the at least two press shoes may have a length in web travel direction of less than or equal to 60 mm, and the process can further include alternatively applying a maximal pressure of a pressure progression within a press nip formed between the first press shoe and the counter roll less than or equal to a value of about 2.5 MPa, and applying a maximal pressure of a pressure progression within a press nip formed between the second press shoe and the counter roll greater than or equal to a value of about 3.3 MPa.

Further, the second press shoe can have a length in the web travel direction less than or equal to about 50 mm, and the process can further include applying a maximal pressure of a pressure progression within the press nip formed between the second press shoe and the counter roll greater than or equal to a value of about 4.3 MPa.

Moreover, the second press shoe can have a length in the web travel direction less than or equal to about 37 mm, and the process may further include applying a maximal pressure of a pressure progression within the press nip formed between the second press shoe and the counter roll greater than or equal to a value of about 4.8 MPa.

In accordance with yet another feature of the instant invention, the apparatus may further include a press felt guided through the press nip, and the process may further include guiding the press felt from an exit of the press nip an angle greater than or equal to about 10° to a tangent to the opposing roll at the exit of the press nip.

In accordance with still yet another feature of the present invention, the apparatus further includes a thin fabric arranged between the web and the felt, and the process can further include deflecting the thin fabric away from the web at an angle less than or equal to the angle of the felt.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
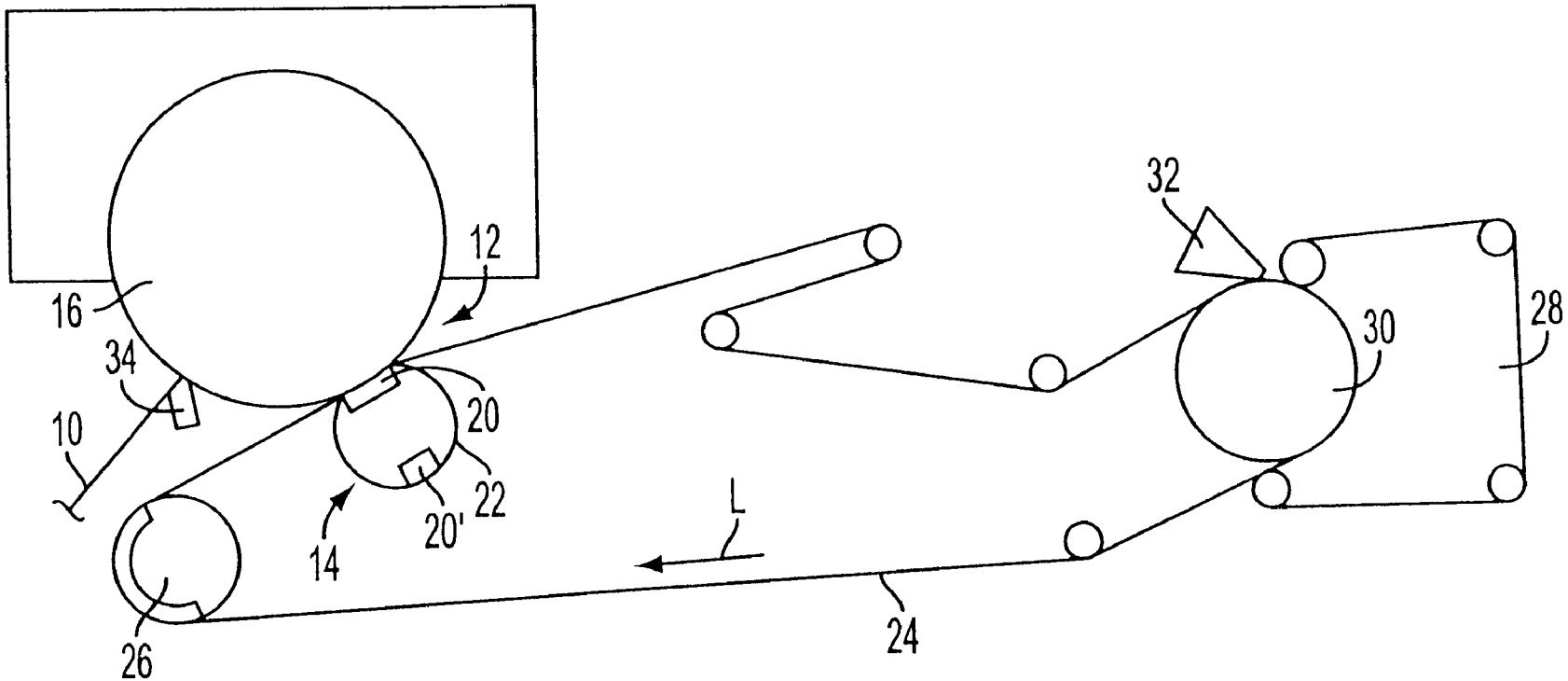
FIG. 1 a schematic representation of a first embodiment of a machine for producing a tissue web with a press section containing a shoe press.
Figure 2:
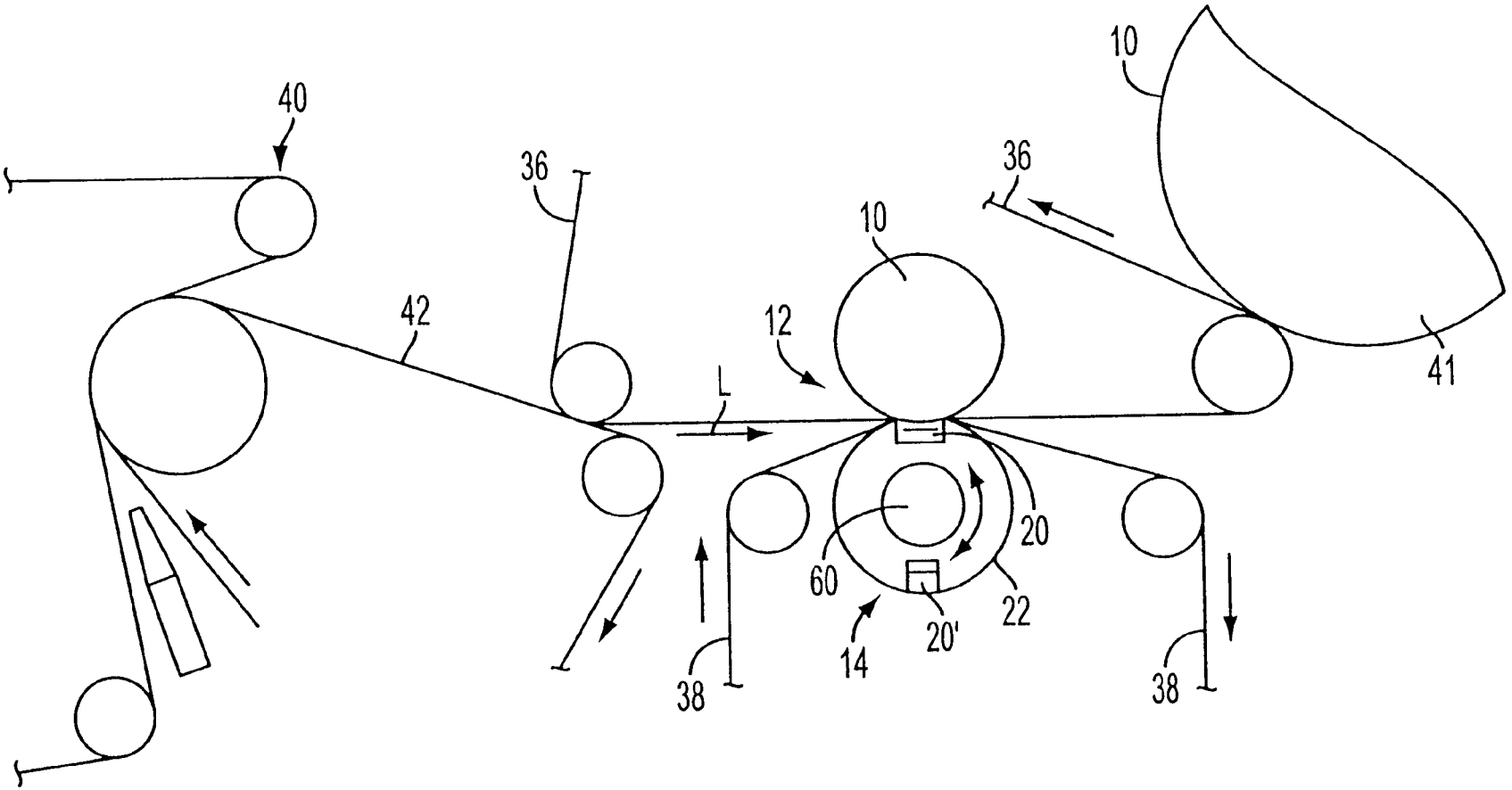
FIG. 2 a schematic representation of another embodiment of such a machine used for producing a tissue web.
Figure 3:
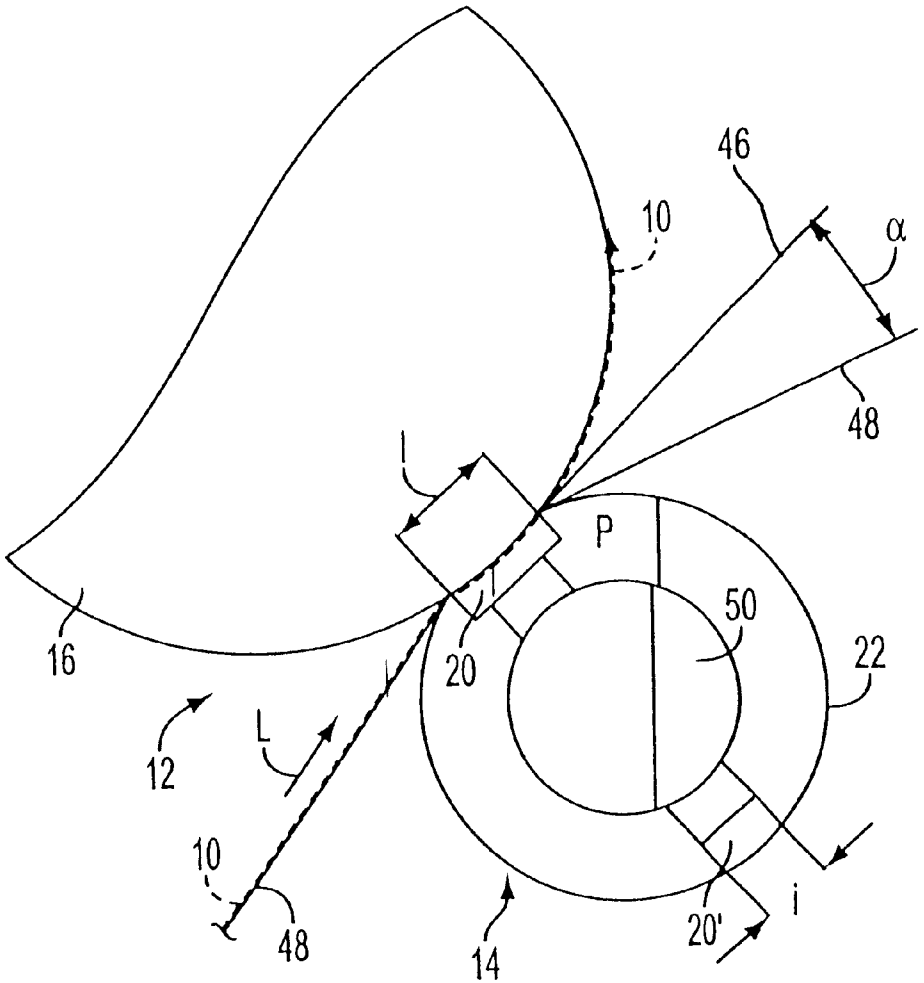
FIG. 3 an enlarged schematic partial representation of a shoe press to be used in such a tissue machine.

FIGS. 1 and 2 each depict a schematic representation of a machine for producing of a tissue web 10 (see also FIG. 3), whose press section includes a shoe press 12 which here contains a shoe press unit, formed by a shoe press roll 14 and a counter roll which, in the case of the embodiment according to FIGS. 1 and 3 is a drying cylinder 16, and, in the embodiment according to FIG. 2, is a conventional counter roll 18.

The shoe press rolls 14 are each provided with two opposing press shoes 20, 20' and a press jacket 22, formed by a flexible, liquid-impermeable press belt guided over this press shoe 20, 20'.

The two press shoes 20, 20' of each shoe press roll 14 have different lengths l, l' measured in the web travel direction L (see FIG. 3, in particular). Additionally, they can each be transferred between an idle position R and a press position P in which each press shoe 20, 20' faces a counter roll 16, 18.

The press shoe 20 can have a length l larger than about 80 mm, for instance, measured in the web travel direction L. If the press nip in question is formed between such a press shoe 20 and the counter roll 16, 18 the maximal pressure of the pressure progression can be selected, in particular, to be less than or equal to a value of about 2.5 MPa.

The length l' of the other press shoe 20', measured in the web travel direction L, can in particular be less than or equal to about 60 mm and, in particular, less than or equal to about 50 mm and preferably have a value in the range of about 37 mm. Here, the maximal pressure progression occurring in a press nip between the press shoe 20' and the counter roll 16, 18 in the web travel direction L is selected at a shoe length less than or equal to about 60 mm, preferably greater than or equal to the value of about 3.3 MPa, at a shoe length less than or equal to about 50 mm preferably greater than or equal to the value of about 4.3 MPa, and, at a shoe length in a range of about 37 mm, preferably equal to a value in the range of about 4.8 MPa. In such a case, a relatively high dry content can be achieved.

A heated drying cylinder 16 and, in particular, a so-called Yankee cylinder, can be provided, for instance, as the counter roll, whose diameter is considerably larger than the diameter of the shoe press roll 14.

In the embodiment according to FIG. 1, a felt 24 is guided through the press nip formed between the shoe press roll 14 and the drying cylinder 16 and is introduced into the press nip via a suction roll 26. The felt 24 wraps a forming roll 30, in whose area a headbox 32 is provided, together with a sheet forming wire 28.

A scraper 34, by which the tissue web 10 is scraped off after being dried, is assigned to the counter roll 16 formed, in particular, by a drying cylinder or a Yankee cylinder.

In the embodiment according to FIG. 2, the counter roll 18 is formed by a normal roll. An upper felt 36 and a lower felt 38 are guided through the press nip formed between the shoe press roll 22 and the counter roll 18. The tissue web to be formed is accepted by the upper felt 36 from a wire 42 approaching from the wire section 40 and introduced to the shoe press 12. Subsequently, the tissue web is introduced to a drying cylinder 44 by the same upper felt 36.

As is discernible from FIG. 3, the angle a, formed between the tangent 46 of the counter roll 16, i.e., the drying cylinder or Yankee cylinder, and felt 48, i.e., at the end of the press nip, can be in particular greater than or equal to about 20°. The press jacket 22 of the shoe press 14 preferably has a grooved surface in the circumferential direction in this case.

Otherwise, the press belt 22 can, in particular, be blind-bored and/or grooved.

The two press shoes 20, 20' can be provided, e.g., at the revolving carrier 50 or the like and can be commonly transferable. (see FIGS. 2 and 3, in particular).

Figure 4:
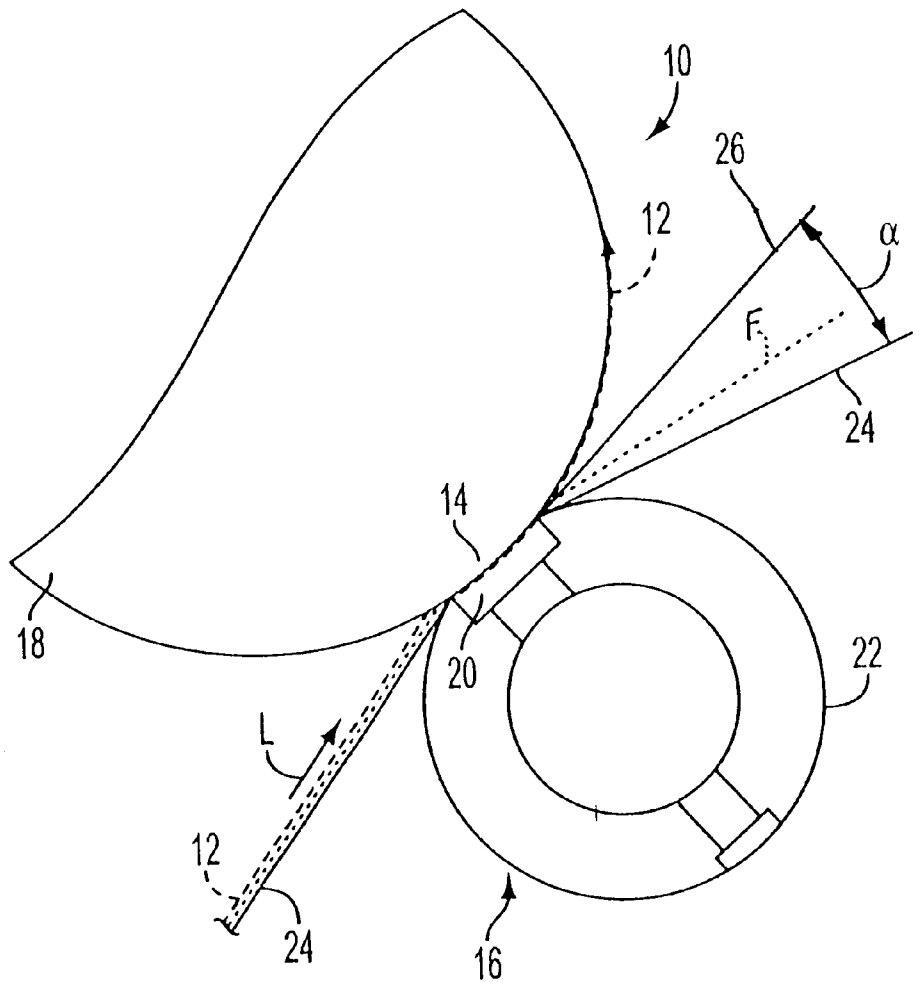
FIG. 4 a schematic representation of another embodiment of such a machine used for producing a tissue web.

In a further embodiment of the invention, as illustrated in FIG. 4, a thin fabric F, e.g., less than 2 mm thick and advantageously less than 1 mm thick, can optionally be positioned between web 12 and felt 24.

According to the invention, thin fabric F is preferably air and water permeable, and can be formed as, e.g., a dewatering wire. As an alternative, thin fabric F may be formed, e.g., as an imprinting wire, which is arranged to create a structure in the web surface.

It is noted that thin fabric F can be guided out of press nip 14 at a same angle as, or at a smaller angle than, felt 24.

It is noted that the foregoing examples have been provided merely for the purpose of explanation and are in no way to be construed as limiting of the present invention.

While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

List of Reference Characters

10 Tissue web
12 Shoe press
14 Shoe press unit, shoe press roll
16 Counter roll, drying cylinder, Yankee cylinder
18 Counter roll
20 Press shoe
20' Press shoe
22 Press belt, press jacket
24 Felt
26 Suction roll
28 Sheet forming wire
30 Former roll
32 Headbox
34 Scraper
36 Upper felt
38 Lower felt
40 Wire section
42 Wire
44 Drying cylinder
46 Tangent
48 Felt
50 Revolving carrier
L Web travel direction
P Press position
R Idle position
l Shoe length
l' Shoe length

What is claimed:

1. The press section of a machine for producing webs comprising:

a shoe press including a shoe press unit and a counter roll;

said shoe press unit comprising at least two press shoes and an elastic liquid-impermeable press belt guided over said at least two press shoes;

said at least two press shoes having different lengths measured in a web travel direction and being arranged for movement to alternatively position said two press shoes in an idle position and a press position facing said counter roll.

2. The press section in accordance with claim 1, wherein the web comprises a tissue web.

3. The press section in accordance with claim 1, wherein said shoe press unit comprises a shoe press roll having a press jacket arranged to form said press belt, and wherein said shoe press roll comprises said at least two press shoes.

4. The press section in accordance with claim 1, wherein at least one of said at least two press shoes has a length in the web travel direction greater than about 80 mm.

5. The press section in accordance with claim 4, wherein a maximal pressure of a pressure progression occurring within a press nip formed between said at least one press shoe and said counter roll is less than or equal to a value of about 2.5 MPa.

6. The press section in accordance with claim 1, wherein at least one of said at least two press shoes has a length in the web travel direction less than or equal to about 60 mm.

7. The press section in accordance with claim 6, wherein a maximal pressure of a pressure progression occurring within a press nip formed between said at least one press shoe and said counter roll is greater than or equal to a value of about 3.3 MPa.

8. The press section in accordance with claim 1, wherein at least one of said at least two press shoes has a length in the web travel direction less than or equal to about 50 mm.

9. The press section in accordance with claim 8, wherein a maximal pressure of a pressure progression occurring within a press nip formed between said at least one press shoe and said counter roll is greater than or equal to a value of about 4.3 MPa.

10. The press section in accordance with claim 1, wherein at least one of said at least two press shoes has a length in the web travel direction less than or equal to about 37 mm.

11. The press section in accordance with claim 10, wherein a maximal pressure of a pressure progression occurring within a press nip formed between said at least one press shoe and said counter roll is greater than or equal to a value of about 4.8 MPa.

12. The press section in accordance with claim 1, wherein said counter roll comprises a heatable drying cylinder.

13. The press section in accordance with claim 12, wherein said heatable drying cylinder comprises a Yankee cylinder.

14. The press section in accordance with claim 1, further comprising a press felt guided through a press nip formed between said shoe press unit and said counter roll, wherein said press felt is guided from an end of said press nip at an angle of greater than or equal to about 10° to a tangent to said counter roll at the press nip exit.

15. The press section in accordance with claim 14, wherein said press felt is guided from the end of the press nip at an angle of greater than or equal to about 15° to the tangent.

16. The press section in accordance with claim 14, wherein said press felt is guided from the end of the press nip at an angle of greater than or equal to about 18° to the tangent.

17. The press section in accordance with claim 14, wherein said press felt is guided from the end of the press nip at an angle of greater than or equal to about 20° to the tangent.

18. The press section in accordance with claim 14, wherein said press belt has a grooved surface in a circumferential direction.

19. The pressing arrangement in accordance with claim 14, further comprising a thin fabric arranged between said at least one press felt and the web.

20. The pressing arrangement in accordance with claim 19, wherein said thin fabric is one of a dewatering wire and an imprinting wire.

21. The pressing arrangement in accordance with claim 19, wherein said thin fabric has a thickness less than about 2 mm.

22. The pressing arrangement in accordance with claim 19, wherein said thin fabric has a thickness less than about 1 mm.

23. The press section in accordance with claim 1, wherein said press belt is one of blind bored and grooved.

24. The press section in accordance with claim 1, wherein said at least two press shoes are arranged for alternative positioning in the press position.

25. The press section in accordance with claim 1, wherein said shoe press unit comprises a rotatable carrier, and said at least two press shoes are coupled to said rotatable carrier.

26. The press section in accordance with claim 24, wherein said rotatable carrier is arranged to alternatively move said at least two press shoes between the idle position and the press position.

27. An apparatus for producing webs comprising:

a shoe press unit comprising at least two press shoes having different lengths in a web run direction and a flexible, liquid impermeable press belt guided over said at least two press shoes;

a counter roll;

said at least two press shoes being alternatively positionable against said counter roll to form a press nip.

28. The apparatus in accordance with claim 27, wherein a first of said at least two press shoes has a length in the web travel direction greater than about 80 mm and a second of said at least two press shoes has a length in web travel direction of less than or equal to 60 mm.

29. The press section in accordance with claim 28, wherein a maximal pressure of a pressure progression occurring within said press nip formed between said first press shoe and said counter roll is less than or equal to a value of about 2.5 MPa, and wherein a maximal pressure of a pressure progression occurring within said press nip formed between said second press shoe and said counter roll is greater than or equal to a value of about 3.3 MPa.

30. The press section in accordance with claim 29, wherein said second press shoe has a length in the web travel direction less than or equal to about 50 mm.

31. The press section in accordance with claim 30, wherein the maximal pressure of a pressure progression occurring within said press nip formed between said second press shoe and said counter roll is greater than or equal to a value of about 4.3 MPa.

32. The press section in accordance with claim 29, wherein said second press shoe has a length in the web travel direction less than or equal to about 37 mm.

33. The press section in accordance with claim 32, wherein the maximal pressure of a pressure progression occurring within said press nip formed between said second press shoe and said counter roll is greater than or equal to a value of about 4.8 MPa.

34. The press section in accordance with claim 27, wherein said shoe press unit comprises a rotatable carrier, and said at least two press shoes are coupled to said rotatable carrier.

35. The press section in accordance with claim 27, wherein said rotatable carrier is arranged to alternatively move said at least two press shoes between the idle position and the press position.

36. A process for producing a web in an apparatus that includes a shoe press unit and an counter roll, the shoe press unit comprising at least two press shoes having different lengths and an elastic liquid-impermeable press belt guided over the at least two press shoes, the process comprising:

alternatively positioning one of the at least two press shoes into a press position to face the counter roll, whereby the other of the at least two press shoes is positioned in an idle position; and guiding the web through a press nip formed between the one press shoe in the press position and the counter roll.

37. The process in accordance with claim 36, wherein a first of said at least two press shoes has a length in the web travel direction greater than about 80 mm and a second of said at least two press shoes has a length in web travel direction of less than or equal to 60 mm, and the process further comprises:

alternatively applying a maximal pressure of a pressure progression within a press nip formed between the first press shoe and the counter roll less than or equal to a value of about 2.5 MPa, or applying a maximal pressure of a pressure progression within a press nip formed between the second press shoe and the counter roll greater than or equal to a value of about 3.3 MPa.

38. The process in accordance with claim 37, wherein the second press shoe has a length in the web travel direction less than or equal to about 50 mm, and the process further comprises:

applying a maximal pressure of a pressure progression within the press nip formed between the second press shoe and the counter roll greater than or equal to a value of about 4.3 MPa.

39. The process in accordance with claim 37, wherein the second press shoe has a length in the web travel direction less than or equal to about 37 mm, and the process further comprises:

applying a maximal pressure of a pressure progression within the press nip formed between the second press shoe and the counter roll greater than or equal to a value of about 4.8 MPa.

40. The process in accordance with claim 36, wherein the apparatus further comprises a press felt guided through the press nip, and the process further comprises:

guiding the press felt from an exit of the press nip an angle greater than or equal to about 10° to a tangent to the opposing roll at the exit of the press nip.

41. The process in accordance with claim 40, wherein the apparatus further includes a thin fabric arranged between the web and the felt, and the process further comprises:

deflecting the thin fabric away from the web at an angle less than or equal to the angle of the felt.

* * * * *